US006681722B1

(12) United States Patent
Maryamchik et al.

(10) Patent No.: US 6,681,722 B1
(45) Date of Patent: Jan. 27, 2004

(54) FLOORED IMPACT-TYPE SOLIDS SEPARATOR USING DOWNWARD EXPANDING SEPARATOR ELEMENTS

(75) Inventors: Mikhail Maryamchik, Copley, OH (US); Michael J. Szmania, Medina, OH (US); David J. Walker, Wadsworth, OH (US); Donald L. Wietzke, Carlsbad, CA (US)

(73) Assignee: The Babcock & Wilcox Company, New Orleans, LA (US)

( * ) Notice: Subject to any disclaimer, the term of this patent is extended or adjusted under 35 U.S.C. 154(b) by 0 days.

(21) Appl. No.: 10/273,917

(22) Filed: Oct. 18, 2002

(51) Int. Cl.[7] ..... F22B 1/00

(52) U.S. Cl. ..... 122/4 D; 122/34; 165/104.16; 55/444; 110/245

(58) Field of Search ..... 122/4 D, 34, 488, 122/489; 165/104.16; 55/444; 110/216, 245

(56) References Cited

U.S. PATENT DOCUMENTS 5,343,830 A * 9/1994 Alexander et al. ..... 122/4 D
5,799,593 A * 9/1998 Belin et al. ..... 110/245
6,095,095 A * 8/2000 Alexander et al. ..... 122/34

* cited by examiner

*Primary Examiner*—Gregory Wilson
(74) *Attorney, Agent, or Firm*—Eric Marich

(57) ABSTRACT

A collection element arrangement is provided having sleeve attachments near their lowermost ends which simulate a continuous sloping surface, or floor. The sleeve attachments upper surfaces forming the floor permit collected solids to flow down the sloping surface back into the furnace or reactor chamber. Stainless steel can be used for the collection elements and sleeve attachments since the floating floor accommodates differential thermal expansion between CFB components.

10 Claims, 3 Drawing Sheets

FLOORED IMPACT-TYPE SOLIDS SEPARATOR USING DOWNWARD EXPANDING SEPARATOR ELEMENTS

FIELD AND BACKGROUND OF THE INVENTION

1. Field of the Invention

The present invention relates generally to the field of industrial power generation and circulating fluidized bed (CFB) reactors and combustors having impact-type particle separators, and, in particular to a new and useful impact-type particle separator for a CFB.

2. Description of the Related Art

In CFB reactors or combustors, reacting and non-reacting solids are entrained within a reactor enclosure by an upward gas flow which carries the solids to an exit at an upper portion of the reactor enclosure. There, the solids are typically collected by an impact type primary particle separator, and returned to a bottom portion of the reactor enclosure either directly or through one or more conduits. The impact-type primary particle separator at the reactor enclosure exit typically collects from 90% to 97% of the circulating solids. If required by the process, an additional solids collector may be installed downstream of the impact-type primary particle separator to collect additional solids for eventual return to the reactor enclosure.

As disclosed in U.S. Pat. No. 5,343,830, the use of impact-type particle separators in CFB reactors or combustors is well known. To the extent necessary to describe the general operation of CFB reactors and combustors, the reader is referred to U.S. Pat. No. 5,343,830, the text of which is hereby incorporated by reference as though fully set forth herein. In one of the earliest CFB designs, an external, impact-type primary particle separator having a plurality of impingement members arranged in staggered rows was used in combination with a non-mechanical L-valve and a secondary (multiclone) particle separator. The rows of staggered impingement members discharged all of their collected solids into a storage hopper located underneath them, and these collected solids were returned to the bottom portion of the reactor enclosure via the L-valve.

Later CFB designs employed additional rows of staggered impingement members which were positioned upstream (with respect to a direction of flue gas and solids flow through the apparatus) of the impingement members associated with the storage hopper and its L-valve. As disclosed in U.S. Pat. No. 4,992,085, the text of which is hereby incorporated by reference as though fully set forth herein, a plurality of such impingement members are located within an upper portion of the reactor enclosure, arranged in at least two staggered rows. The impingement members hang and extend vertically across a width of the reactor exit, with collected solids falling unobstructed and unchanneled underneath these collecting impingement members along a rear enclosure wall of the CFB reactor or combustor. An important element of these "in-furnace" collecting impingement members, or "in-furnace U-beams" as they are generally referred to, is a baffle plate near a lower end of these impingement members which enhances their collection efficiency.

As disclosed in the aforementioned U.S. Pat. No. 5,343,830, CFB reactors or combustors are known wherein the two or more rows of impingement members located within the furnace or reactor enclosure are followed by a second array of staggered impingement members which further separate particles from the gas stream, and return them via cavity means and particle return means without external and internal recycle conduits.

U.S. Pat. No. 6,095,095 teaches a further improvement in impact-type solids separators for a CFB which is a simpler and lower cost impact-type primary particle separator. Instead of providing a cavity means or hopper with discharge openings underneath the collector elements making up the impact-type primary particle separator, the separator of U.S. Pat. No. 6,095,095 has a simple floor for internal return of all primary collected solids to a bottom portion of the reactor or combustor for subsequent recirculation.

U.S. Pat. No. 6,095,095 does not address the mechanical aspects of the individual separator elements, however, including relative thermal expansion between the elements (or U-beams) and the enclosure walls. As noted above, a hopper is not used in the separator of U.S. Pat. No. 6,095,095.

It is often desirable to utilize collection elements like U-beams made of stainless steel and hung from the roof of the CFB reactor while operating in a floored impact collector mode. However, when a solid floor is located beneath the collector elements, the U-beams may expand onto a pile of solids as a result of thermal expansion of the U-beam metals. When the collection elements touch the solids piles, a high compressive force is exerted on the long dimension of the U-beams. Thus, because of the large thermal expansion in the length of the U-beams which can be expected with stainless steel U-beams and the need to avoid placing large compressive forces on the U-beams, a gap must be available between the lower ends of the U-beams and enclosure floor so that the collection elements can freely expand.

SUMMARY OF THE INVENTION

It is an object of the present invention to provide an impact-type separator for a CFB which accounts for thermal expansion of the separator elements.

A further object of the invention is to provide an arrangement of collection elements having gaps for free thermal expansion of the elements within the enclosure in a floored collection element environment.

Accordingly, a collection element arrangement is provided having attachments near their lowermost ends which simulate a continuous sloping surface, or floor. The sleeve attachments' upper surfaces, forming the floor, permit collected solids to flow down the sloping surface back into the furnace or reactor chamber. The sleeve attachments are fitted around each element. The outer wall of each attachment is positioned to leave a small gap between the adjacent sleeve and/or CFB enclosure walls. The upper surface of the sleeve attachments block off the lower ends of the collection elements as well. The attachments are integrally connected with the collection elements, so that they expand together through increasing temperatures in the CFB during operation startup.

In an alternative embodiment, the CFB may include a staggered array of heat exchange tubes for solids collected by the collection elements to pass through prior to returning to the reactor chamber.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENTS

Figure 1:
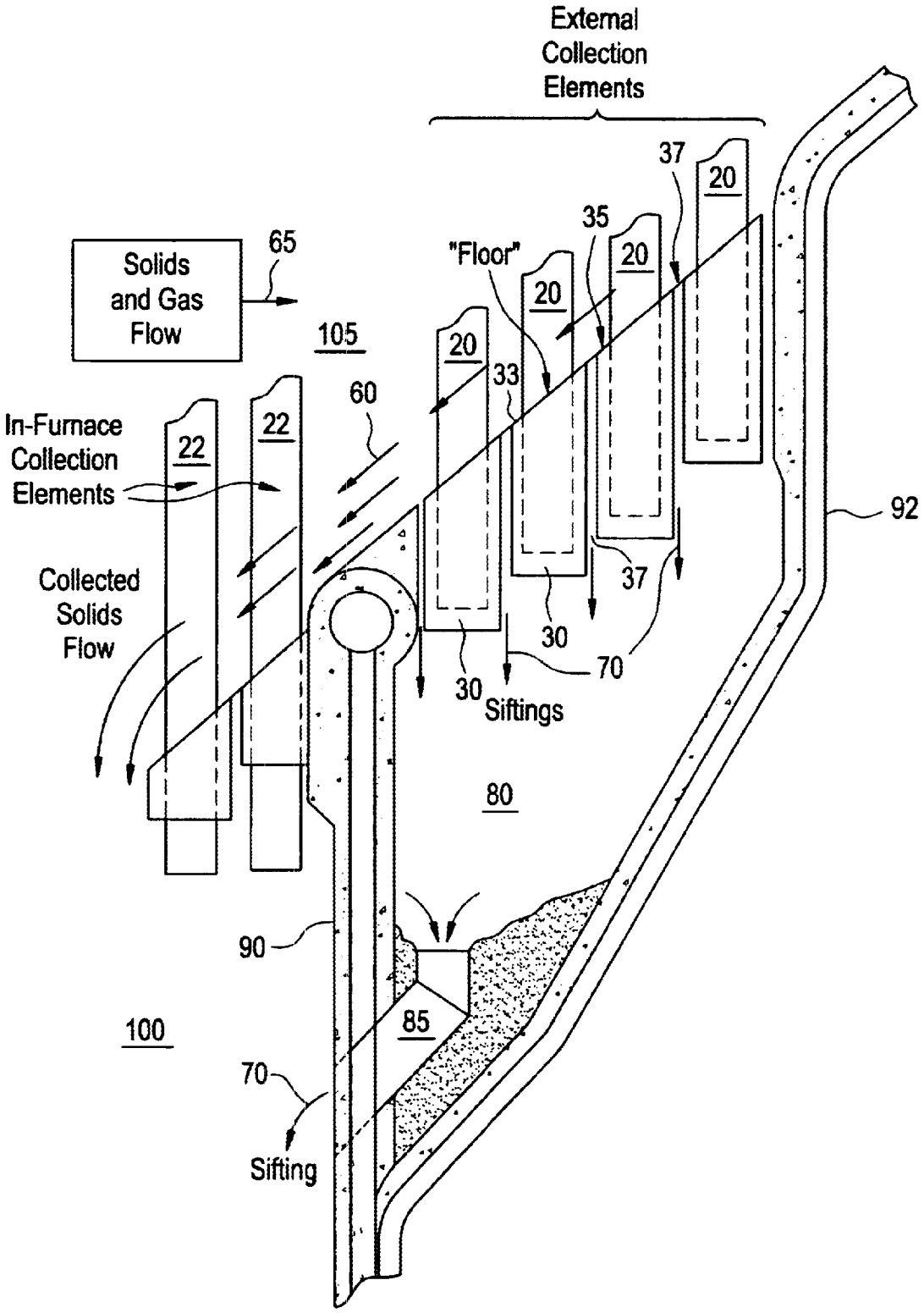
FIG. 1 is a sectional side elevation of a CFB having collection elements according to the invention.

Referring now to the drawings, in which like reference numerals are used to refer to the same or similar elements, FIG. 1 shows a CFB furnace or reactor chamber 100 having an adjacent collection chamber 80 and a passage 85 between them for returning solids to the furnace or reactor chamber 100. The upper end of the furnace chamber 100 is connected to a flue 105 for hot gases and entrained solids 60 to exit the system.

Two sets of impact-type solids separators are provided in the flue 105. A first set of collection elements are provided on the furnace chamber 100 side of chamber wall 90 and are known as internal collector elements 22. A second set of collection elements 20 are positioned in the flue 105 between the chamber wall 90 and collection chamber wall 92, over the collection hopper 80. The second set of collection elements are external collection elements 20.

Each set of collection elements 20, 22 are preferably U-beams, as known in the art, oriented to face the furnace chamber 100. Each collection element 20, 22 has a sleeve attachment 30 around its lower end which encloses the U-beam channel. A sloped floor 35 is formed by the upper surfaces 33 of sleeve attachments 30 around the vertical surfaces of collection elements 20, 22. The floor 35 is sloped at an angle with respect to the horizontal to cause solids particles 60 falling thereon to be returned to the chamber 100. The sleeve attachments 30 are integral with the collection element 20, 22 to which they are connected. Small gaps 37 are provided between adjacent sleeve attachments 30 so that the sleeves 30 and collection elements 20, 22 may expand together with Increased temperatures in the reactor enclosure.

Thus, the floor 35 is effectively floating, supported from above by the collection elements 20, 22. In an alternative embodiment, the sleeve attachments 30 may actually "float" on the U-beams 20, so that if the siftings 70 pile in the hopper 80 grows too large, the sleeve attachments 30 simply ride up the U-beams 20, raising the floor 35 slightly.

Entrained solids in the gases 65 impact the collection elements 20, 22. Solids hitting the collection elements 20, 22 fall downwardly within the U-beam collection elements 20, 22 and onto the floor 35 formed by the sleeve attachments 30. The solids then slide down the sloped floor 35 and return to the furnace chamber 100 under force of gravity.

Other solids 60 which fall out of the entrained solids and gases 65 may be sufficiently small that they pass through gaps 37 between adjacent sleeve attachments 30 into collection hopper 80 as "siftings" 70. The siftings 70 are returned to the furnace chamber 100 via passage 85. The gaps 37 are provided to ensure free vertical movement of the collection elements 20, 22 and sleeve attachments 30 and allow for horizontal expansion of the elements 20, 22 and attachments 30 as well.

In use, the sleeve attachments 30 expand up and down a few inches with the U-beam collection elements 20, 22 as the temperature varies during start up and full operation. Preferably, the sleeve attachments 30 and U-beams are both made of stainless steel, although other materials used for impact-type separators can be substituted as well. A benefit of the invention is that stainless steel collection elements 20, 22 can be used, while providing the effect of a floored impact-type separator, such as described in U.S. Pat. No. 6,095,095. Stainless steel is most preferred as a material because of its reliability when used in impact-type separators. The sloping floor 35 formed by the sleeve attachments 30 permits the use of stainless steel because it accommodates the relatively large coefficient of thermal expansion of the steel which creates large differential thermal expansion with other components of the CFB reactor, while giving the benefit of a floored separator.

In a preferred embodiment, each sleeve attachment 30 is formed integral with the U-beam 20, 22 to which it is connected for mechanical integrity and support.

In a further embodiment, the height of the individual sleeve attachments 30 may be different between rows, so that the horizontal thrust force from the flowing gases and solids 65 entering the external collection element array is carried back to the enclosure wall behind the array.

Figure 2:
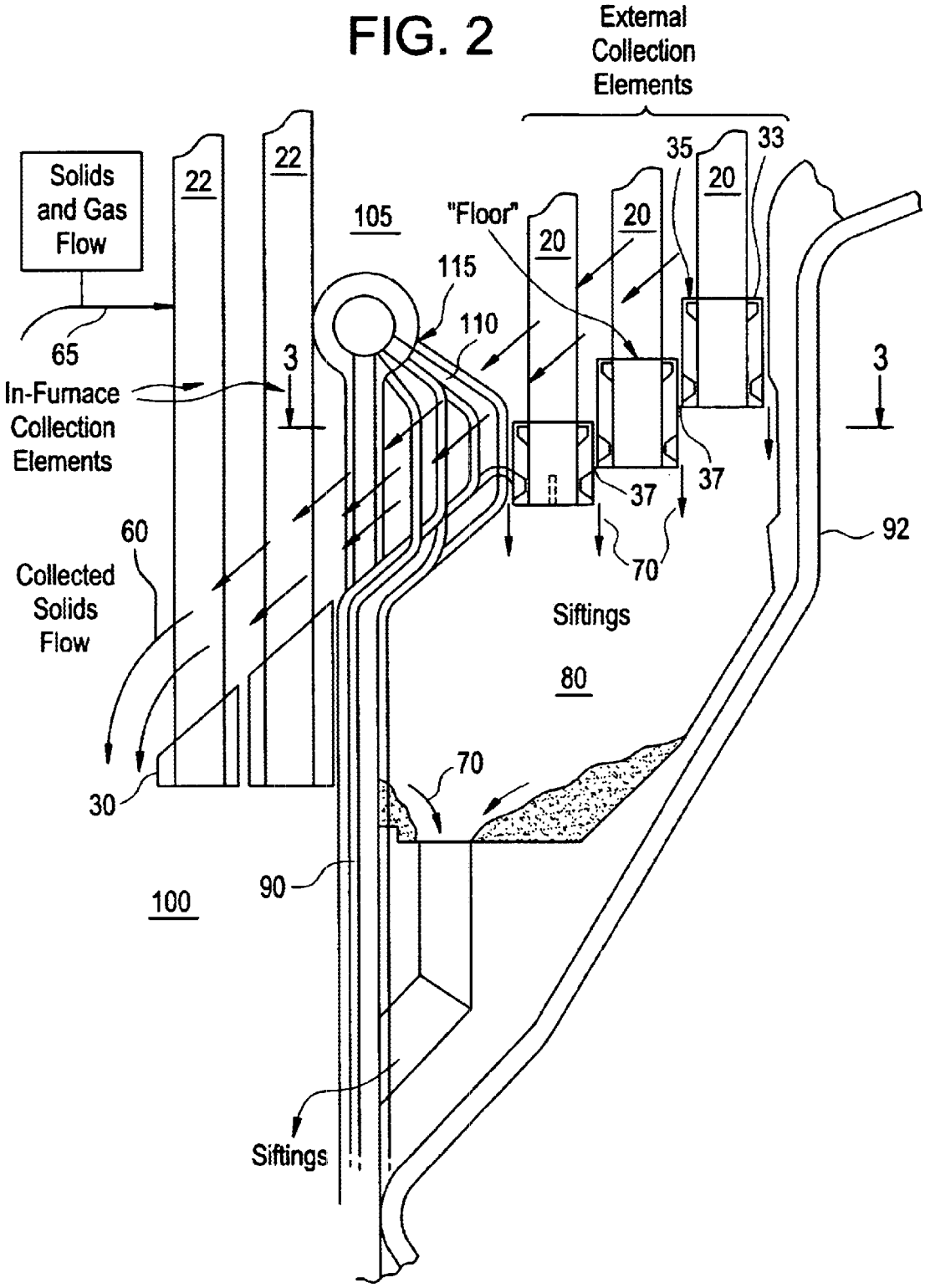
FIG. 2 is a sectional side elevation of an alternate embodiment of the collection elements of the invention.
Figure 3:
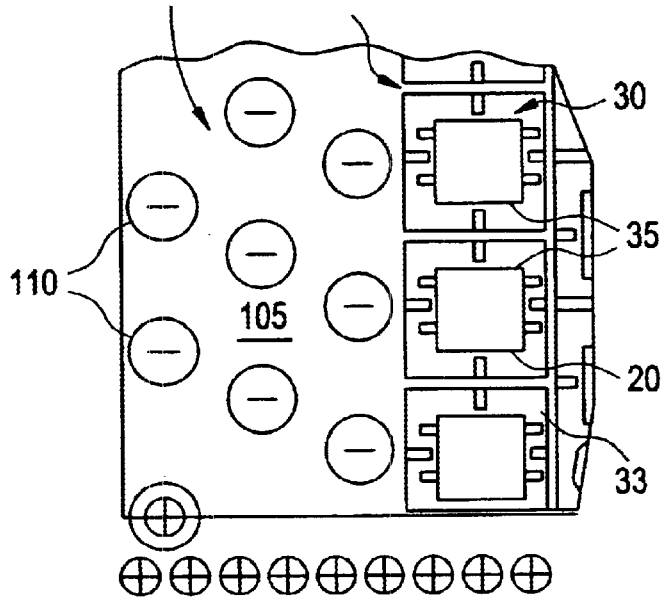
FIG. 3 is a top plan view of the tube and collection element arrangement of FIG. 2 taken along line 3—3.

FIGS. 2 and 3 illustrate a different CFB reactor arrangement using the suspended floor 35 of the invention with collection elements 20, 22. In the alternative arrangement, a series of water tubes 110 arranged in a staggered array 115 in the flow path of the downward flowing solids 60. The water tubes 110 extend partly into the flow path of the gases and entrained solids 65 as well. The water tubes 110 are preferably extensions of the furnace chamber wall 90.

The same variations discussed above for the sleeve attachments 30 and collection elements 20, 22 may be applied to the embodiment shown in FIGS. 2 and 3.

Figure 4:
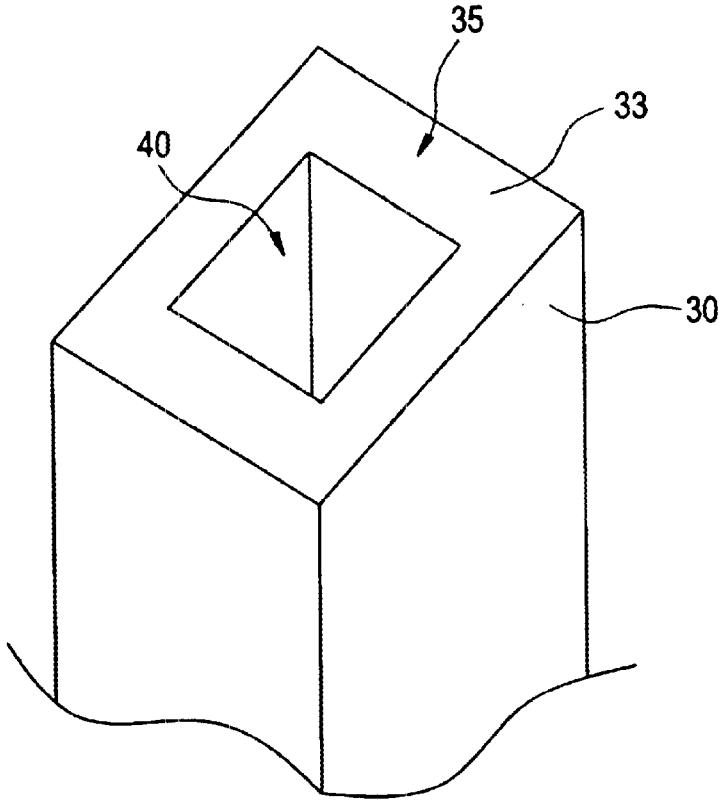
FIG. 4 is a perspective view of the upper end of one of the attachments for the collection elements of FIG. 1.

FIG. 4 illustrates a sleeve attachment 30 for use with the invention. The opening 40 is fitted around a collection element 20, 22 and connected to the lower end to form the floor 35 with the sleeve attachment upper surfaces 33.

While a specific embodiment of the invention has been shown and described in detail to illustrate the application of the principles of the invention, it will be understood that the invention may be embodied otherwise without departing from such principles.

We claim:

1. An impact-type separator for a circulating fluidized bed reactor, the separator comprising:

a spaced apart array of collection elements depending from a roof of the circulating fluidized bed reactor; and a plurality of sleeve attachments, one attachment surrounding the lower end of each of the collection elements in the array, each attachment having a substantially planar upper surface connected to the collection element, the upper surfaces of the plurality of sleeve attachments cooperating with each other to form a floor around the collection elements in the array, wherein the individual collection elements may expand from heating independently of and without interference from other collection elements or circulating fluidized bed components and by-products.

2. The impact-type separator according to claim 1, wherein the elevation of the individual upper surfaces of the attachments provides a floor sloped at an angle with respect to the horizontal.

3. The impact-type separator according to claim 2, wherein at least some of the upper surfaces of the attachments are sloped at the same angle as that of the floor.

4. The impact-type separator according to claim 1, wherein the collection elements are made of stainless steel.

5. The impact-type separator according to claim 1, wherein the collection elements are U-beams.

6. The impact-type separator according to claim 1, wherein each sleeve attachment is connected integral with the corresponding collection element.

7. The impact-type separator according to claim 1, wherein the sleeve attachments are slidably connected to the collection elements.

8. The impact-type separator according to claim 1, wherein the floor includes small gaps defined by the edges of adjacent ones of the upper surfaces of the sleeve attachments.

9. The impact-type separator according to claim 1, wherein heat transfer surface is placed in the flow path of the downward flowing solids collected by the collection elements.

10. The impact-type separator according to claim 1, further comprising a siftings collection hopper below at least a portion of the collection elements, the hopper being in communication with a reactor chamber of the circulating fluidized bed.

* * * * *